United States Patent [19]

Weigl et al.

[11] 4,165,883

[45] Aug. 28, 1979

[54] SAFETY SKI BINDING

[75] Inventors: Erwin Weigl, Brunn am Gebirge; Karl Stritzl, Vienna, both of Austria

[73] Assignee: TMC Corporation, Baar, Switzerland

[21] Appl. No.: 880,078

[22] Filed: Feb. 22, 1978

[30] Foreign Application Priority Data

Feb. 23, 1977 [AT] Austria ..... 1212/77

[51] Int. Cl.[2] ..... A63C 9/08

[52] U.S. Cl. ..... 280/618

[58] Field of Search ..... 280/618, 626, 627, 628

[56] References Cited

U.S. PATENT DOCUMENTS

| | | | |
|---|---|---|---|
| 3,997,188 | 12/1976 | Begsy | 280/618 X |
| 4,033,603 | 7/1977 | Horn | 280/618 |
| 4,060,257 | 11/1977 | Jungkind | 280/626 |
| 4,095,814 | 1/1978 | Weigl | 280/618 |

*Primary Examiner*—Robert R. Song
*Assistant Examiner*—Gene A. Church
*Attorney, Agent, or Firm*—Blanchard, Flynn, Thiel, Boutell & Tanis

[57] ABSTRACT

A safety ski binding mounted on member movable with respect to the ski but fixedly secured thereto. A release of the ski boot from engagement with the ski binding is initiated by forces applied to the heel holder. The heel holder is movable about both a vertical axis and a horizontal axis so that it is responsive to not only vertical and horizontal applied forces by the ski boot but also diagonally applied forces. A connecting lever-like element is movably secured to the housing for the heel holder and has one end thereof connected to a piston reciprocally movable in an open-sided cylinder on the housing. Thus, a reciprocal movement of the piston will initiate a pivotal movement of the connecting element. The other end of the connecting element is pivotally attached to a lock so that the lock is movable in response to a pivotal movement of the connecting element. The lock has a protuberance which projects over a lip on the heel holder to hold the heel holder in the boot holding position. Thus, a pivotal movement of connecting element in response to release forces applied by the ski boot to the binding will effect an unlocking of the heel holder and a release of the ski boot.

18 Claims, 14 Drawing Figures

SAFETY SKI BINDING

FIELD OF THE INVENTION

The invention relates to a safety ski binding, preferably but not necessarily having a sole plate or the like for supporting a front jaw and a heel holder, the ski boot being held in its clamped-in or boot holding position between the ski binding parts (in the downhill position) in the heel area by a locking member which is movable against the force of a spring in a housing or the like, which locking member engages a holding member.

BACKGROUND OF THE INVENTION

A ski binding of the abovementioned type, in which the ski binding parts are mounted on a plate, is described for example in German OS No. 2,221,105. In this known device the locking members act against a release toward the side either only in the front or only in the rear, however, against a release upwardly both in front and also in the rear. However, the boot is released only after the plate is completely separated from the ski and the ski boot and the plate are released together from the ski. This has the disadvantage that the plate must move through a relatively large toggle lever range until it is released by the locking members and can release from the ski. The resulting time delays can possibly be disadvantageous with respect to the safety, particularly at very high skiing speeds in which a delay of the release mechanism can occur. Therefore, in the known ski binding, the initial tension of the spring which effects the release is adjusted in consideration of these circumstances. The more rigid spring adjustment in turn has the consequence that a release will possibly occur in response to high impact forces, which with a further adjustment or initial tension of the springs would still lie in the elastic range of the binding.

An improved heel holder for a ski binding of the abovementioned type is described in U.S. Pat. No. 4,003,603. In this construction, the locking member is provided on the plate, the holding member on the ski, wherein, as is actually known, the one holder can be moved relative to the plate, which holder is held in the downhill position by a control member which is associated with the locking member, which control member releases the holder after movement of the rear plate end a certain degree, which holder releases the boot and subsequently under the action of the spring which loads the locking member pivots the plate about the pivot bearing back into its initial position and holds it on the ski.

The just now described construction has the disadvantage, that the heel holder always opens up upwardly, regardless of whether the outside forces which act on the plate cause a release upwardly, to the side or diagonally. This has the disadvantage that the forces which do not fall in direction of the direct release suffer a loss in the form of additional friction, so that only the associated vector of the power parallelogram prevails. Another disadvantage of the known construction is that a subsequent and/or separate adjustment of the actual heel holder to the boot is not possible, because the holder and the locking member are adjusted constantly to one another.

The purpose of the invention is to overcome the mentioned disadvantages and to design a heel holder of the abovementioned safety ski binding such that between the heel holder and the clamped-in ski boot there can be assured a separate and possibly adjustable thrust adjustment.

In addition, the invention is to facilitate the use of the aforedescribed measure also in the case of a heel holder, namely without the use of a sole plate or the like. Finally the plate is supposed to be able to be replaced also with a differently designed holding element in order to reduce the weight of the safety ski binding.

The set purpose is attained according to the invention by arranging a pin on a movable part of the locking member. One end of a connecting element engages the pin, the other end thereof being connected through a joint to a spring-loaded lock which fixes the heel holder in the tensioned position (in the downhill position), and which lock is pivotally supported on an axle which extends at a right angle to the longitudinal axis of the ski and in the downhill position substantially parallel to the upper side of the ski and which is arranged on or in a housing part of the locking member. The possibly provided sole plate, as is actually known, is to be secured in its front area against a lifting off from the ski while being swingable or liftable from the ski approximately in the center area about a ski-fixed pin.

The inventive construction of the safety ski binding produces particularly advantageous friction conditions for the release operation, because the lock is pivotally supported and by providing a connecting element between the lock and the carrier, a speed ratio is produced which is favorable for the release operation and which can be changed to a limited degree. In addition, the invention facilitates the use of the heel holder both in connection with a sole plate or the like and also the heel holder by itself.

It is thereby possible to form the sole plate, if provided, inventively by a pair of parallel rods which extends in longitudinal direction of the ski and which is supported swingably upwardly at the two front free ends in a ski-fixed mounting member and is held in the rear area by the housing of the locking member. A web member is connected between the two rods and has a bearing which operatively functions with a ski-fixed pin. In this manner, the effect which is achieved by using a sole plate is met in totality, the weight of the entire ski binding is, however, reduced. Using the pair of rods permits, in addition, a particularly simple development of an adjustable front jaw.

In a further development of this thought of the invention, the pair of rods may have teeth thereon, along which a conventional adjusting bridge is longitudinally guided, adjustably and releasably lockable. According to a further thought of the invention, it is possible to arrange in the adjusting bridge a multiply bent spring wire which forms the front jaw, the free ends of which spring wire are anchored in the adjusting bridge at least through a double bent section, so that the spring wire has an initial tension. The spring wire has in the area which is associated with the tip of the ski boot on both sides a further, preferably double (approximately S-shaped) bent section, which is constructed offset rearwardly (toward the heel of the boot) in relationship to the tip of the boot. In this manner the ski boot is held resiliently and laterally supported through a holder which is designed as short as possible limited to some millimeter in longitudinal direction of the ski. The springiness is less at any rate than the overlap of the holder on the heel of the boot.

BRIEF DESCRIPTION OF THE DRAWINGS

Further advantages, in particular further inventive developments of the heel holder, and further details of the invention will be described more in detail with reference to the drawings which illustrate several exemplary embodiments.

In the drawings:

FIG. 1 illustrates a central cross-sectional view along the longitudinal axis of the ski of a first embodiment of the inventive safety ski binding, wherein between the ski boot and the ski there is provided a support which carries the ski binding parts and which consists of linkages;

FIGS. 2 and 3 illustrate details of FIG. 1, wherein FIG. 2 is a side view of the release level and FIG. 3 is a side view of the heel holder;

FIGS. 6 to 10 illustrate a second embodiment of the safety ski binding designed as a heel holder without using a sole plate or the like, wherein FIGS. 6–8 are side elevational views, FIGS. 7 and 8 being partly in cross section, in a closed condition of the heel holder and in a loaded condition within the elasticity limit or in a vertical released condition, FIGS. 9 and 10 each illustrating a top view of the heel holder portion during a horizontal release, wherein FIG. 9 illustrates a position lying within the elasticity limit and FIG. 10 shows the released condition;

FIG. 11 is a top view of the pivot area;

FIG. 14 is a top view of the front mounting member for the pair of rods.

DETAILED DESCRIPTION

Figures 1, 2, 3, 11, 14:
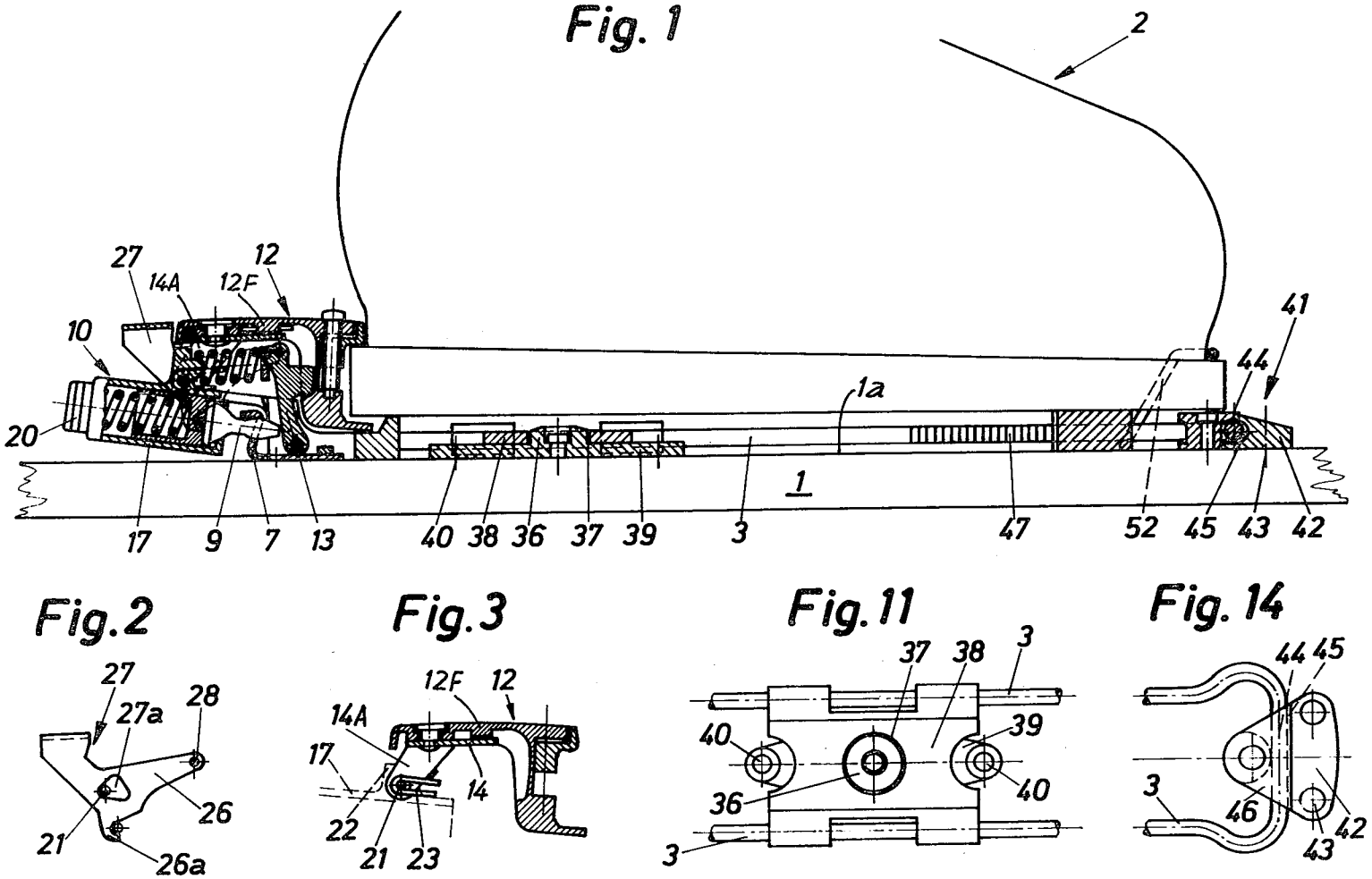

The safety binding illustrated in FIG. 1 has a ski boot 2 clamped between a front jaw 41 and a heel holder 12 and having a pair of rods 3 positioned therebetween on the upper side 1*a* of a ski 1. The construction of the pair of rods 3 can particularly easily be recognized from FIG. 13; the detail thereof will be discussed hereinbelow. FIGS. 1 and 14 illustrate a two-part mounting member 42 secured by means of screws 43 to the upper side 1*a* of the ski. The front end of the pair of rods 3 is pivotally anchored in the mounting member 42 and movable about an axis 44 extending substantially at a right angle to the longitudinal axis of the ski. The pair of rods 3 is supported for an upward pivotal movement about the aforesaid axis 44 in the mounting member 42. For this purpose, the mounting member 42 has in the area adjacent the axis 44 at least one opening 45 preferably constructed in the form of a hole. In order to be able to perform a lateral release function, the rods 3 are also pivotally supported for movement laterally (from the longitudinal axis of the ski toward either of the two side edges of the ski). The hole is enlarged at both ends as at 46 on both sides of the mounting member 42. In this manner, the pair of rods 3, which defines a support member, can move in accordance with the control offered by the heel holder 12 and the locking member 10 to effect a release of the ski boot without utilizing additional elements.

In the rear portion of the ski binding, the two free ends of the pair of rods 3 are supported in a housing 17 in which is arranged a locking member 10. The housing 17 also supports the heel holder 12. The details of the locking member 10 and the heel holder 12 are also illustrated in FIG. 1, however, they are better illustrated in FIG. 4 and reference will be made hereinbelow thereto.

A holding part 7 is secured to the upper side 1*a* of the ski by means of screws 6. The holding part is constructed in one piece with a support plate 4 and the screws 6 are secured through the support plate 4. A friction-reducing element 5 is arranged in the present exemplary embodiment on the underside of the housing 17, which underside is not illustrated in detail, and reduces the friction forces which occur during a release operation and which occur between the individual structural parts (4, 5 and 17) of the safety ski binding. The holding part 7 has an approximately Z-shaped constructed member extending upwardly from the support plate 4. The Z-shaped member has a recess 8 therein for receiving the stem of a mushroom-shaped locking element 9. The development of the holding part 7 is furthermore recognizable by also looking at the embodiment according to FIGS. 9 and 10. The mushroom-shaped locking element 9 is supported in the locking member 10 and its enlarged head or cap 9′ is supported against a piston 18 reciprocally movable against the force of a spring 19 in an approximately cylinder-shaped constructed part of the locking member 10 portion of the housing 17. The initial tension of the spring 19 can be regulated in a conventional manner by an adjusting screw or by using inserts; in the present exemplary embodiment an adjusting screw 20 is used.

The heel holder 12 consists of two parts 12F and 14A. The part 14A is pivotally supported through an axle 21 on a bearing block 22 fixedly connected to the housing 17. The axis of the axle 21 extends substantially at a right angle to the longitudinal axis of the ski. In this embodiment, the bearing block 22 is constructed in one piece with the housing 17; however, it may also be constructed as a separate structural part, or it may be manufactured in one piece with the heel holder. In the two latter cases, the bearing block 22 would be for example screwed, riveted or in any other desired manner secured to the housing 17. To increase the opening readiness of the heel holder 12, the part 14A of the heel holder which is operatively associated with the axle 21 is biased by one leg of a torsion spring 23, while the other leg of it is supported on the upper side of the housing 17.

The heel holder is, as illustrated in FIG. 1, held down in the tensioned or boot holding position for the ski boot 2 (in the downhill position) by a lock 13. The lock 13 includes a nose 13*a* which grips over and engages a projecting part 12*c* on the heel holder 12.

Figure 4:
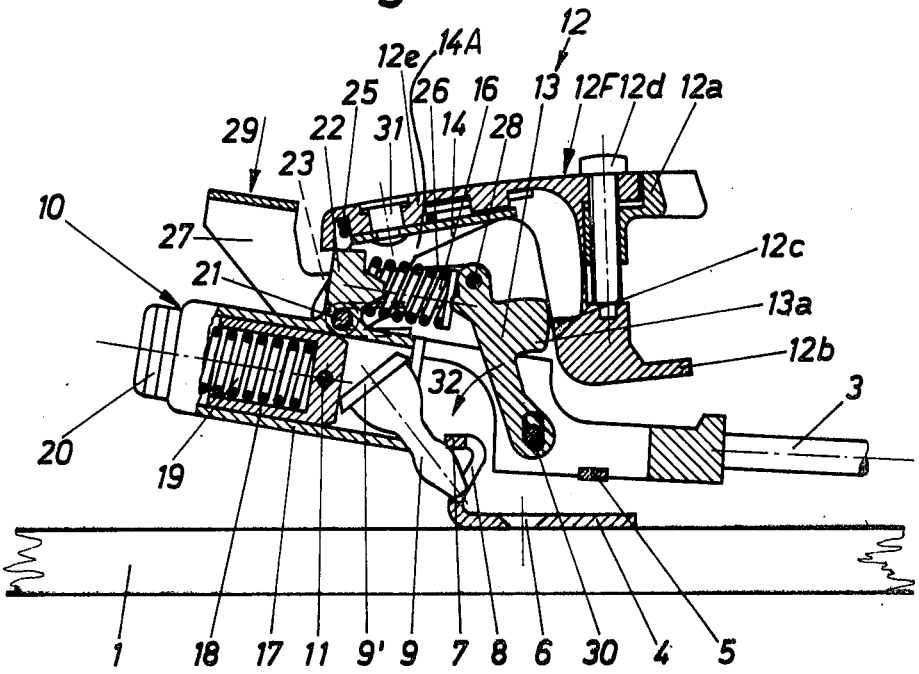
FIG. 4 is an enlarged cross-sectional view of the heel holder portion of FIG. 1 in the open position following a vertical release operation.
Figure 5:
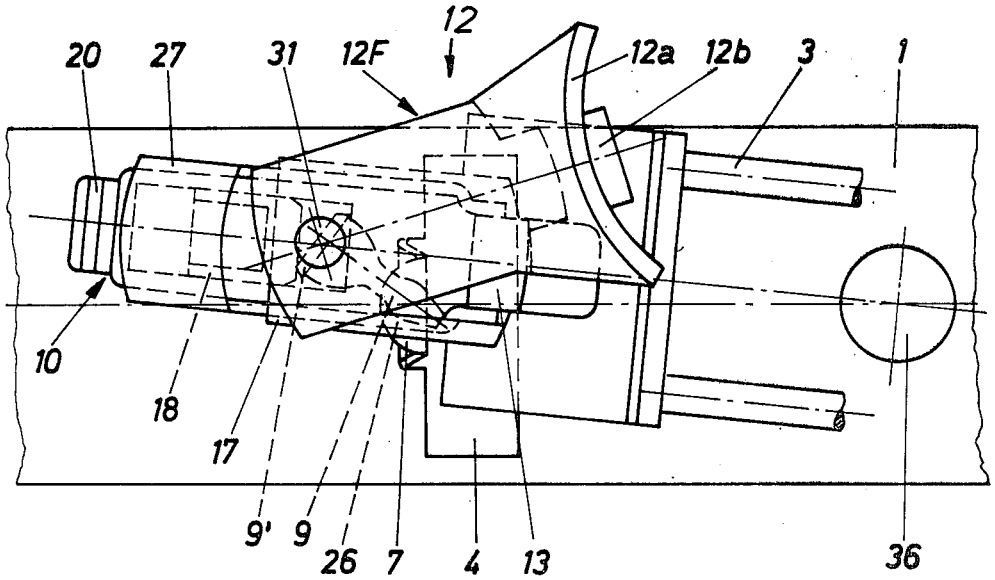
FIG. 5 is a top view of the heel holder portion of FIG. 1 in the open position following a lateral release operation.

The lock 13 is pivotally supported on an axle 30 secured to a part of the housing 17 and extends transversely to the longitudinal axis of the ski. A pivot joint 28 is mounted on the end of the lock 13 remote from the axle 30 and extends substantially parallel to the axle 28. One end of a connecting element 26 (FIG. 2) is pivotally mounted to the axle 30, the other end thereof engages a pin 11 secured to and movable with the movable piston 18 in the locking member 10. In the present exemplary embodiment, the end of the connecting element 26 adjacent the pin 11 is constructed as a hook 26*a*, so that, viewed from the direction of the mushroom-shaped locking element 9, the connecting element 26 is open in the area of the pin 11. This measure will be discussed below. The connecting element 26 is constructed in the present exemplary embodiment as part of a release lever 27; the release lever 27 facilitates the arbitrary opening of the heel holder 12. The lock 13 is spring biased on its side remote from the nose 13*a* by a spring 16 engaged therewith, the other end of the spring 16 is supported against the bearing block 21. The release lever 27 has an enlarged hole or guideway 27*a* in the area of the axle 21 and the free movement thereof is limited by the peripheral limits of the guideway 27*a*. The heel holder 12 has, as is actually known, a spur 12*b* (FIG. 4) which is suited for stepping down by the ski boot 2 during the stepping-in operation, a holding part 12*a* for holding down the heel of the ski boot 2 and, for adjusting the holding part 12*a* to different thicknesses of boot soles, an adjusting screw 12*d* which adjustably secures the holding part 12*a* to the heel holder 12. On the part 12*e* of the heel holder 12, which part extends rearwardly away from the boot heel, a connecting pin 31 defining a verticle axle is arranged through which the heel holder 12 is pivotally secured to the arm 14 of the heel holder part 14 which is pivotally secured as aforesaid to the axle 21 (see also FIG. 3). Thus the heel holder part 12F can be swung not only upwardly, but also swung about the connecting pin 31 in the horizontal plane, to cause during a release operation the ski boot 2 to also be totally released, if in the front area, like in the present exemplary embodiment according to FIG. 1, a stiff front jaw is provided. If particularly in the case of a construction without a sole plate or the like a lateral release is provided by using a resilient front jaw, then this measure is not needed. The spring 25 assures that an automatic return of the heel holder part 12F into the (centered) center position. A pivoted position of the heel holder part 12F is illustrated in FIG. 5.

A pin 36 (FIG. 11) is secured to the upper side 1*a* of the ski in the space for the foot of the skier between the toe jaw and heel holder. The pin 36 is received in a hole in a web 38 secured to and extending between the rails 3 to define a bearing 37. The web 38 is held nonmovably on the pair of rods 3. The pin 36 is constructed as an upwardly projecting part of a mounting member 39 which extends in longitudinal direction of the ski, has a circular cross section and is secured by means of screws 40 on the upper side 1*a* of the ski. The mounting member 39 can also be worked partly into the ski and can be secured therein for example by an adhesive.

Figure 12:
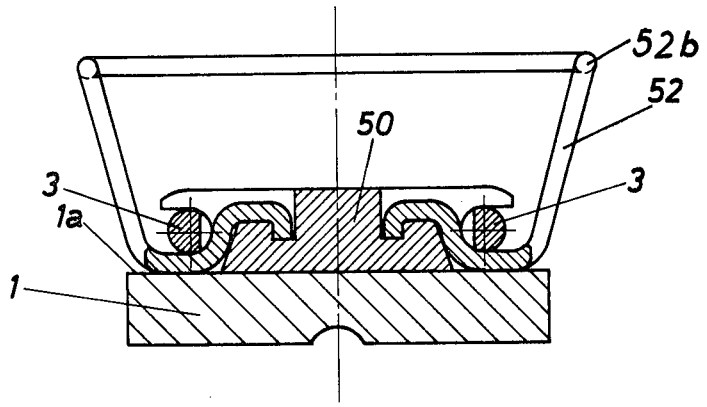
FIG. 12 is a cross-sectional view taken along the line XII—XII of FIG. 13
Figure 13:
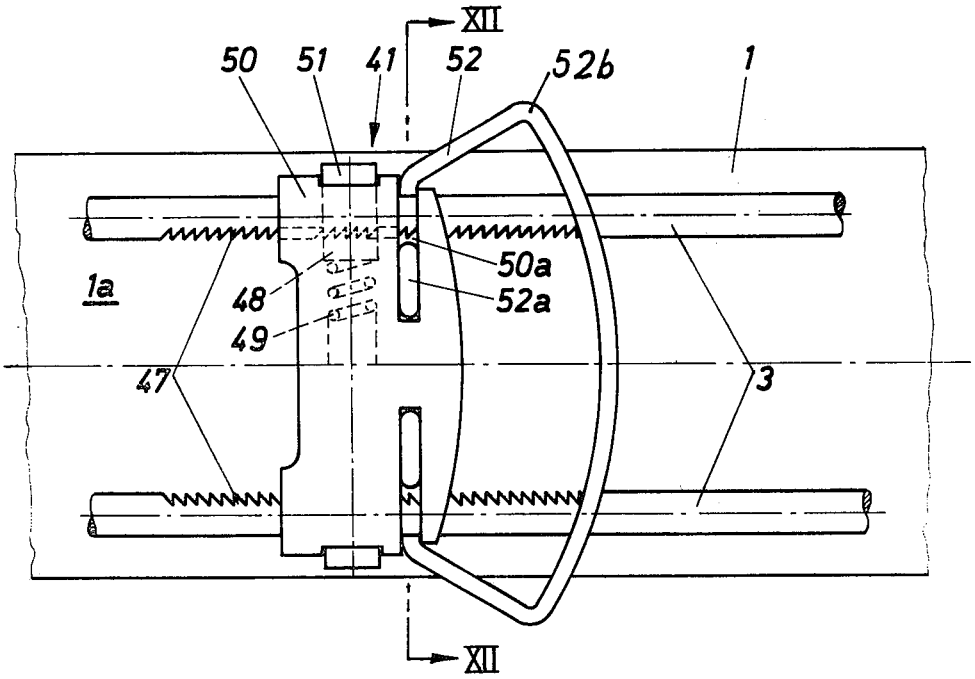
FIG. 13 is a top view of the front jaw structure of FIG. 12.

The front jaw 41 will now be described with reference to FIGS. 12 and 13. The pair of rods 3 have teeth 47 thereon, with each of which a resilient locking element 48, 49 can engage. The pair of rods 3 are thereby bridged by an adjusting bridge 50 defining a carriage and the action of the springs 49 onto the locking elements 48 can be cancelled by the pressure members 51 which are arranged on both sides. By simultaneously operating the two pressure members 51, the locking elements 48 become disengaged from the teeth 47 and thereafter the adjusting bridge 50 can be moved into the desired position to compensate for the size of the ski boot 2. Locking of the bridge 50 can take place by releasing the manual engagement of the pressure members 51.

A holder which is formed of a multiply bent spring wire is anchored in the adjusting bridge 50. The holder holds the ski boot 2 against the tension of the locking member 10 on the pair of rods 3 in boot holding condition. As can be recognized from FIGS. 1, 12 and 13, the spring wire 52 is formed such that starting out from the points of securement to the bridge 50 two legs 52 extend inclined upwardly and forwardly (to the tip of the ski boot), whereat they have a double bend 52*b* and a suitable curvature therebetween after reaching the upper edge of the sole in order to then grip around the tip of the ski boot (above the sole). The spring wire 52 has at its points of securement (at the two ends of the spring wire) at least two bent sections which secure the ends of the spring wire 52 against a lateral sliding out of the adjusting bridge 50. In the present exemplary embodiment, the spring wire is guided on its area 52*a* which extends in the adjusting bridge 50 additionally in recesses 50*a* in the adjusting bridge 50, so that the support of the spring wire 52 will prevent a pivoting about an axis which extends substantially at a right angle to the longitudinal axis of the ski. Thus the spring wire 52 forms a fixed, however, to a certain degree elastic, mounting for the ski boot 2, which resiliency contributes to increasing the elasticity limit. Through the two side areas of the spring wire 52 (compare particularly FIG. 1), which side areas extend along the sole of the ski boot 2, the ski boot 2 is held by the front jaw 41 supported in lateral direction. The front mounting 42 for the pair of rods 3 has already been described above.

OPERATION

The inventive safety ski binding operates as follows: If now excessive vertical, lateral or diagonally acting forces occur, which would in every case cause a swinging of the heel holder 12, these forces effect first a certain lifting of the pair of rods 3 from the upper side 1*a* of the ski and the pair of rods 3 is swung upwardly about the axis 44 without, however, causing a disengagement between pin 36 and bearing 37. The mushroom-shaped locking element 9 assumes thereby the position illustrated in FIGS. 4 or 5, wherein the cap 9' of the mushroom-shaped locking element 9 moves the piston 18 against the force of the spring 19. The part of the release lever 27 which is constructed as a connecting element 26 (and thus also the release lever 27) is thus carried along by the pin 11 and the lock 13 is pivoted against the force of the spring 16 through the pivot joint 28 from its locking position which is formed with the heel holder 12 in FIG. 1 about the axle 30 in direction of the arrow 32. FIG. 4 shows the already released position of the heel holder 12 (without showing the ski boot 2). Lets assume that the ski boot has in this position already left the heel holder 32, the closing action of the spring 19 on the locking element 9 occurs and the heel holder 12 is automatically returned into a ready position (open). The heel holder 12 is thereby kept open through the action of the torsion spring 23; during a stepping in on the spur 12*b*, the projecting part or lip 12*c* is pressed down below the nose 13*a* of the lock 13 and causes the ski boot 2, now under the common (summed) tensioning force of the two springs 16, 19, to be held pressed on the front jaw 41. It can easily be recognized that through the symmetrical circular construction of the cap 9' of the mushroom-shaped locking element and the corresponding front side of the piston 18, this action occurs also when the outer forces act in a diagonal direction. The release of the boot occurs in this case in a similar manner as in a release upwardly.

In order to facilitate purely lateral release due to pure lateral forces even when the front jaw 41, as illustrated and described, does not permit any lateral swing, the heel holder part 12F is pivoted about the connecting pin 31 in the horizontal plane against the force of the spring 25. This measure can be advantageous also when a diagonal release occurs, because the ski boot is in this manner more safely released.

The embodiment according to FIG. 4 illustrates the heel holder 12 after a release operation, during which vertically acting forces exclusively occur. FIG. 5 illustrates the case wherein the release is in response to vertical and lateral forces. FIGS. 2 and 3 illustrate details, which contribute to a better understanding of the already described construction of the inventive safety ski binding; a further discussion of these parts should not be necessary.

ALTERNATE CONSTRUCTION

Figure 6:
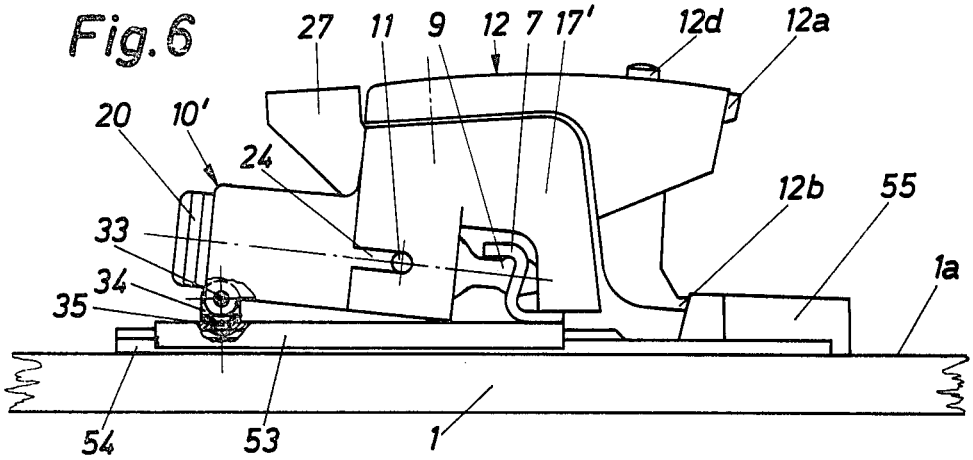
Figure 7:
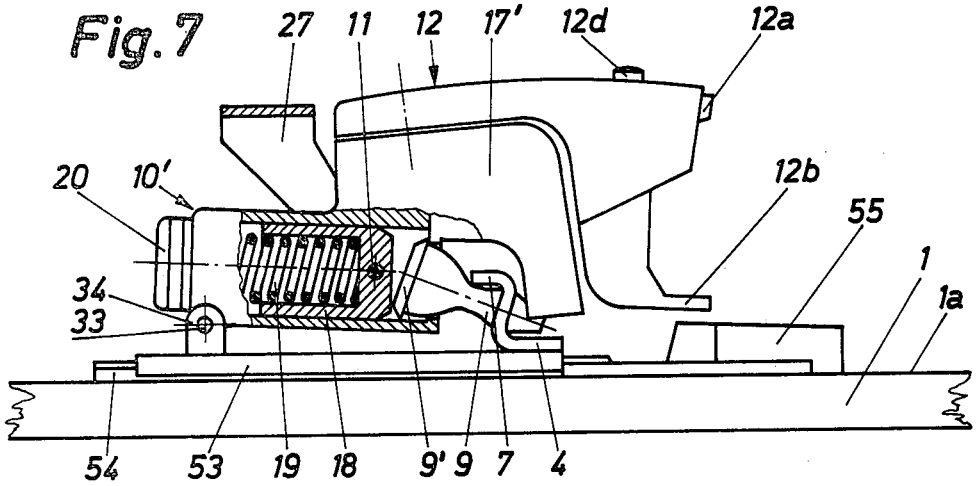
Figure 8:
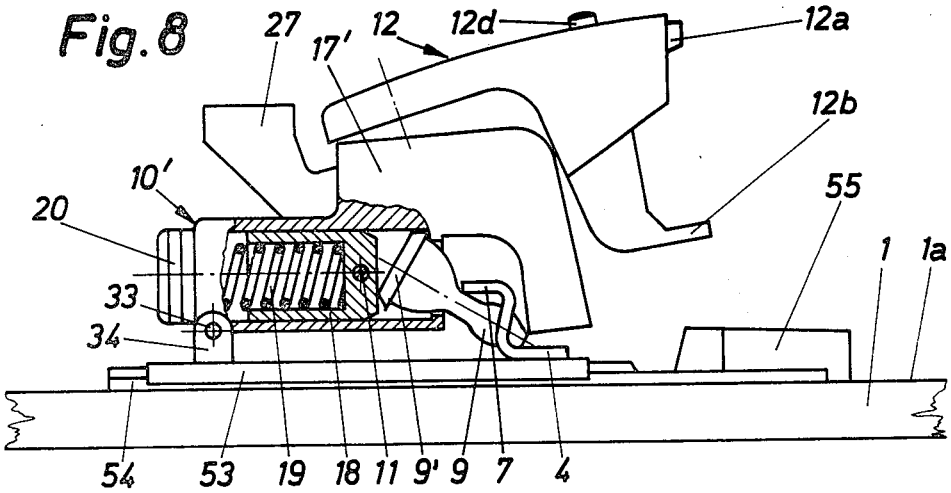
Figure 9:
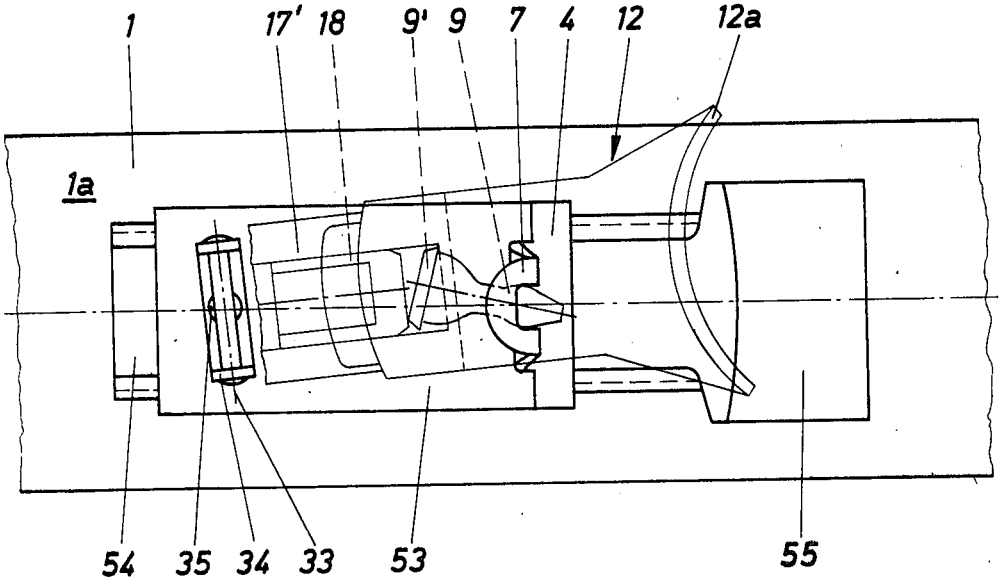
Figure 10:
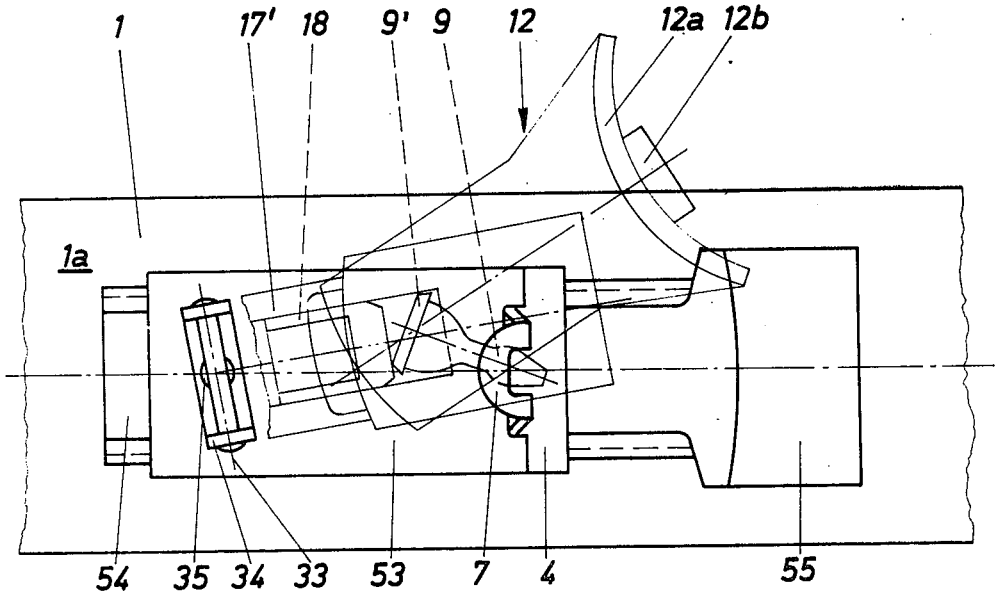

A further exemplary embodiment is illustrated in FIGS. 6 to 10. According to this exemplary embodiment, the heel holder 12 is arranged on a locking member 10', the housing 17' of which is pivotally secured for movement about a horizontal axle 33 in a bearing 34 which is, in turn, pivotal about a vertical connecting pin 35. A universal jointlike mounting is produced through this construction and causes the locking member 10' to be pivoted upwardly in relationship to the ski 1 or to the upper side **1*a* of the ski both about the axis of the axle 33 and also horizontally about the connecting pin 35. All movements which are possible and which are transferred from the mushroom-shaped locking element 9 onto the locking member 10' are facilitated by the latter. In the present exemplary embodiment according to FIGS. 6–10, the universal jointlike mounting is not directly secured on the upper side 1*a* of the ski but on a carriage 53 which can be moved in longitudinal direction of the ski on a base plate 54 to permit an adjustment of the heel holder 12 to different length ski boots, even when—not like in the present exemplary embodiment according to FIG. 1—the front jaw is arranged fixedly on the upper side of the ski. Such a design of heel holders is particularly known for rental designs, so that further discussion is not needed for the man skilled in the art. FIG. 6 illustrates thereby the heel holder 12 in the closed condition, in cross-section in the area of the universal jointlike mounting, otherwise in side elevation; FIG. 7 illustrates the start of a release operation and FIG. 8 illustrates a finished release operation. Since the remaining details both of the heel holder and also of the locking member are already known from the preceding description, further discussion of the details is believed unnecessary. In addition, here too a conventional support plate 55 which provides the release operation with a friction-reducing element (not separately illustrated) is provided. FIGS. 9 and 10 each are top views of two different release operations, wherein according to FIG. 9 only the locking member 10' is loaded through a lateral stress, however, according to FIG. 10 also the heel holder is pivoted about the axis of the connecting pin 31 (against the force of the spring 25 in FIG. 4**). Further details of these two figures can be taken from the present description.

The design and the described operation will enable recognition that the invention safety ski binding, independent from the direction of the created forces, which act onto the ski boot, releases the ski boot from the binding in every case. The release takes place even when the front jaw consists only of a spring steel wire. By suitably designing the holding part 7, namely the recess 8 therein, a further advantage can be seen in that the release upwardly or laterally takes place under different speed ratios which can be chosen advantageously 1:2. Further transmission ratio possibilities lie in the various pivot points for the vertical and horizontal movements.

The invention is not to be limited to the illustrated exemplary embodiments. It has already been shown that the described and illustrated designs can also be varied among one another. A further modification consists in a different front jaw or heel holder being used for the construction of the heel holder or the front jaw according to FIG. 1. Also using the heel holder according to FIGS. 6–10 is not bound to any special front jaw. As mentioned, the swivelling of the heel holder 13 in the horizontal plane is not needed, when a front jaw is used which is suited for receiving lateral forces and for a safety release.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heel holding device for a safety ski binding having a heel holder and support means for pivotally securing said heel holder to a ski adjacent the rear end of said heel holder, a holding member mounted on a ski, said heel holder being held in a boot holding position by a locking member supported for movement in a housing against the force of a spring, said locking member being mounted on the rear end portion of said heel holder and operatively engaging said holding member, the improvement comprising a locking element mounted for pivotal movement about a pivot axle on said housing relative to said heel holder about an axle extending transversely to the longitudinal axis of said ski into and out of locking engagement with said heel holder and resilient means for urging said locking element into said locking engagement with said heel holder to hold a heel of a ski boot to said ski, connecting means for connecting said locking member to said locking element so that a movement of said locking member in response to a separating force between said ski and said ski boot will effect a pivotal movement of said locking element toward said out of locking engagement position with said heel holder to facilitate a release of said ski boot from said ski.

2. The improved ski binding according to claim 1, wherein said locking member includes a piston which is loaded by said spring, said piston having a pin member thereon movable therewith, said connecting element having a hooklike extension thereon engaging said pin member so that movement of said piston in response to said separating force will effect a movement of said locking element toward said out of locking engagement position.

3. The improved ski binding according to claim 2, wherein said hooklike extension opens in a direction facing away from said piston.

4. The improved ski binding according to claim 1, wherein said connecting element includes a release lever arm which facilitates the arbitrary opening of said heel holder, said arm having a hooklike extension thereon which opens in a direction facing away from said piston.

5. The improved ski binding according to claim 1, wherein said spring and said resilient means define two forces which must be exceeded in effecting a release of said ski boot from said ski.

6. The improved ski binding according to claim 1, wherein said heel holder is pivotally supported for movement about a pivot axle against spring force in the horizontal plane.

7. The improved ski binding according to claim 1, wherein said housing includes means defining a bearing block thereon, said bearing block having an axle the axis of which extends substantially parallel to said pivot axis for said locking element, said heel holder being pivotally supported on said axle.

8. The improved ski binding according to claim 7, wherein a torsion spring is arranged around said axle of said heel holder, said spring effecting an opening of said heel holder, said torsion spring having one leg thereof supported on said housing and the other leg thereof supported on said heel holder.

9. The improved ski binding according to claim 1, wherein said housing includes universal bearing support means mounted on said ski for pivotally supporting said housing about mutually perpendicular axes relative to said ski.

10. The improved ski binding according to claim 1, including a sole plate formed by a pair of rods which extends coextensively along the longitudinal axis of said ski and mounting means mounted on said ski for supporting said pair of rods for limited upward pivotal movement at the two front free ends thereof, said housing being mounted on and movable with said sole plate adjacent the rear thereof.

11. The improved ski binding according to claim 10, wherein said mounting means includes means defining an axle which extends substantially at a right angle to the longitudinal axis of said ski, said pair of rods being pivotal upwardly about said axle limited by the limits of relative movement between said locking member and said holding member.

12. The improved ski binding according to claim 10, wherein said pair of rods has teeth thereon, along which a carriage is longitudinally guided, said carriage including releasable locking means operatively connected to said teeth to facilitate an adjustment and releasable locking of said carriage relative to said pair of rods.

13. The improved ski binding according to claim 12, wherein said releasable locking means includes resilient locking elements which are movable into and out of locking engagement with said teeth by means of pressure members which can be operated against the resilient force of said resilient locking elements.

14. The improved ski binding according to claim 13, including a spring wire in said carriage, which spring wire forms a front jaw of said ski binding and is bent to overlie the toe portion of the sole of said ski boot, said spring wire including means for preventing a lateral movement relative to said ski and a pivoting about an axis which lies substantially at a right angle with respect to the longitudinal axis of said ski.

15. The improved ski binding according to claim 14, wherein said spring wire has two ends which are coupled to said carriage and prevent said lateral movement, said spring wire being received in said recesses in said carriage, so that the position of the spring wire can be adjusted with respect to the ski boot length with movement of said carriage relative to said pair of rods.

16. The improved ski binding according to claim 15, wherein said spring wire is generally U-shaped and has upwardly inclined and forwardly extending legs relative to said carriage, the ends of said legs adjacent said carriage are bent to a generally double S-shape to effect a securement thereof to said carriage.

17. The improved ski binding according to claim 1, wherein said support means supports said heel holder for movement about mutually perpendicular axes extending transversely to the longitudinal axis of said ski.

18. The improved ski binding according to claim 9, wherein said housing has further support means thereon for supporting said heel holder for movement about mutually perpendicular axes extending transversely to the longitudinal axis of said ski.

* * * * *